United States Patent [19]

Van Dine

[11] 4,183,334

[45] Jan. 15, 1980

[54] FUEL SAVING CONTROL SYSTEM FOR INTERNAL COMBUSTION ENGINES

[75] Inventor: Max Van Dine, Jefferson County, Ill.

[73] Assignee: The Vapolean Corporation, Glen Burnie, Md.

[21] Appl. No.: 773,609

[22] Filed: Mar. 2, 1977

[51] Int. Cl.[2] ..... F02M 7/00

[52] U.S. Cl. ..... 123/119 EC; 123/127; 123/139 AV

[58] Field of Search ..... 261/67, 68, 69 R, 51, 261/DIG. 74; 123/119 R, 119 EC, 139 AV, 136, 127

[56] References Cited

U.S. PATENT DOCUMENTS

| | | | |
|---|---|---|---|
| 2,755,075 | 7/1956 | Tivoli | 261/51 |
| 3,357,687 | 12/1967 | Vanderpoel | 261/51 |
| 4,075,982 | 2/1978 | Asano | 123/119 EC |

FOREIGN PATENT DOCUMENTS

| | | | |
|---|---|---|---|
| 2318793 | 4/1972 | Fed. Rep. of Germany | 123/119 EC |
| 2549887 | 5/1976 | Fed. Rep. of Germany | 123/119 EC |

*Primary Examiner*—Ronald H. Lazarus

*Attorney, Agent, or Firm*—Gravely, Lieder & Woodruff

[57] ABSTRACT

A control system for improving the efficiency of an internal combustion engine includes a metering unit which divides the fuel line leading to the carburetor of the engine into a plurality of branches. All but one of the branches have solenoid valves which when closed completely block their respective branches. These branches are further provided with micrometer valves which are adjustable to vary the flows through the branches. The remaining branch also contains an adjustable valve which is set such that when all the other branches are blocked at their valves, the remaining branch supplies enough fuel to maintain the engine operating at idle or up to a specific power setting. The metering unit is coupled to a sensing unit which in turn is connected to the throttle of the carburetor. The sensing unit contains switches corresponding in number to the solenoid valves in the metering unit, and these switches are closed successively as the throttle is opened. Consequently, the solenoid valves open and close in response to the throttle position, so that each branch corresponds to a specific range of throttle positions. The arrangement is such that just enough fuel is supplied at the upper end of each range to meet the engine power demands, so that the air fuel mixture for any specific range corresponds more precisely to the optimum for the range.

18 Claims, 8 Drawing Figures

FUEL SAVING CONTROL SYSTEM FOR INTERNAL COMBUSTION ENGINES

BACKGROUND OF THE INVENTION

The invention relates in general to internal combustion engines, and more particularly to a fuel control system for making such engines more efficient.

Most automobile engines operate on gasoline which is ignited by a spark produced within a combustion chamber. As a consequence these engines require a carburetor to vaporize the gasoline and mix it with air to form a combustible mixture. Carburetors of current manufacture vaporize the gasoline by discharging it through a fuel jet into an airstream passing through a venturi in the carburetor. The orifice in the fuel jet, however, is of fixed diameter, and that diameter represents somewhat of a compromise which permits relatively good operation over a wide range of power settings, but does not provide optimum operation at any power setting. Actually, the orifice of the jet is somewhat oversized for most power demands, so that the compromise favors high power demands, since without the large diameter, the engine would be incapable of developing full power on the few occasions when that is necessary. Also, the oversized jet orifices enable the engine to operate at higher altitudes with little difficulty. Consequently, under most operating conditions, the combustible mixtures supplied to the engines of current manufacture are too rich in gasoline.

Translating the foregoing into the operation of a conventional gasoline powered automobile, under most driving conditions the carburetor supplies more gasoline to the engine than is required to maintain the power for that operating condition. This is particularly true during deceleration when the throttle is released, but the carburetor nevertheless supplies a relatively large charge of gasoline to the engine in view of the large amount of air which is pumped. Also at idling, where the engine requires only enough power to overcome its own internal friction, the gasoline consumed is usually in excess of the amount which is actually necessary to overcome the friction. Even at normal driving speeds the engine receives more fuel than is necessary to maintain such speeds, and the same is true for moderate accelerations to normal driving speeds. Moreover, most vehicles are operated at relatively low altitudes, but the carburetors are designed to operate at higher altitudes as well and, therefore, supply an overly rich air-fuel mixture at the lower altitudes.

SUMMARY OF THE INVENTION

One of the principal objects of the present invention is to provide a fuel control system which meters the fuel supplied to the engine in a manner consistent with the power demands placed on the engine. Another object is to provide a fuel control system of the type stated which is easily installed in the engine compartments of conventional gasoline-powered automobiles and trucks. A further object is to provide a control system of the type stated which renders and automotive engine significantly more efficient. An additional object is to provide a control system which monitors the throttle setting and meters the fuel accordingly. Still another object is to provide a control system which enables the air-fuel mixture for an engine to more closely approach an optimum value over the full range of power demands placed on the engine. These and other objects and advantages will become apparent hereinafter.

The present invention is embodied in a control system for an internal combustion engine and includes sensing means for ascertaining power demands placed on the engine and metering means for metering the fuel supplied to the engine in response to power demands sensed by the sensing means. The invention also consists in the parts and in the arrangements and combinations of parts hereinafter described and claimed.

DESCRIPTIONS OF THE DRAWINGS

In the accompanying drawings, which form part of the specification and wherein like numerals and letters refer to like parts wherever they occur:

DETAILED DESCRIPTION

Figure 1:
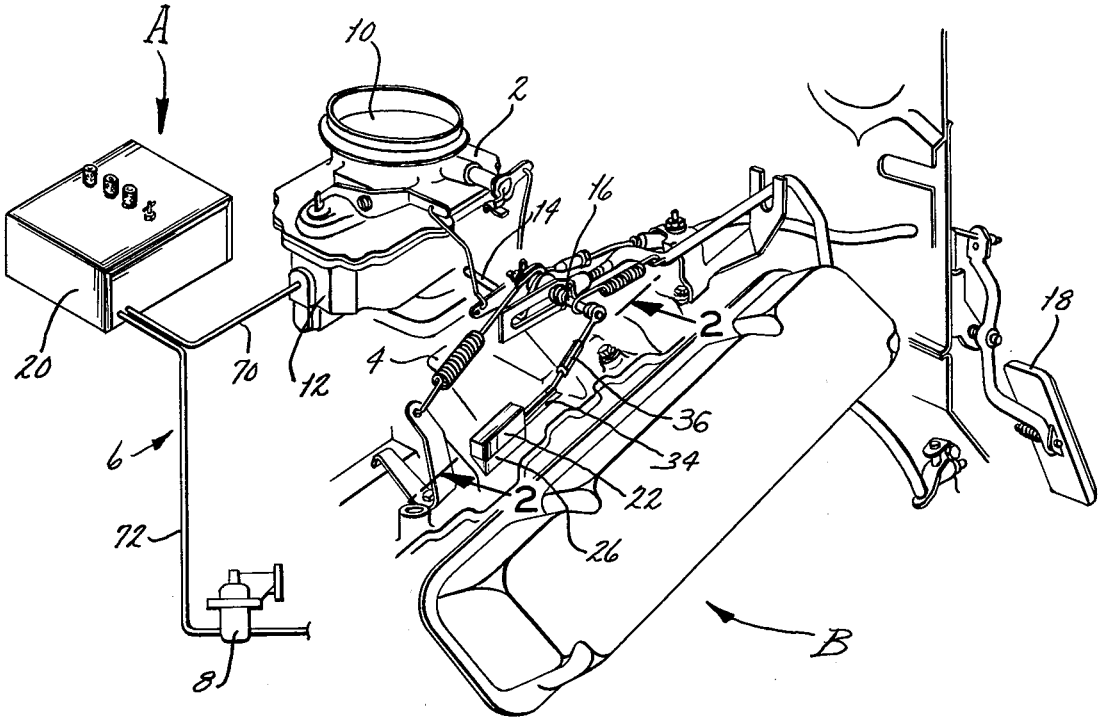
FIG. 1 is a fragmentary perspective view of an automotive engine provided with the fuel control system of the present invention.

Referring now to the drawings (FIG. 1), A designates a control system which is used in conjunction with a conventional internal combustion engine B of the spark ignition type typically used in automotive vehicles. The engine B contains the usual pistons which reciprocate in cylinders by virtue of the ignition of a combustible mixture in those cylinders. The combustible mixture is derived from a carburetor 2 and is delivered to the cylinders through an intake manifold 4 on which the carburetor 2 is mounted, all in the usual manner. The carburetor derives the gasoline from a fuel line 6 which is pressurized by a fuel pump 8. In most engines the fuel line 6 extends directly from the fuel pump 8 to the carburetor. In the engine B the control system A is interposed in the fuel line 6 between the fuel pump 8 and the carburetor 2 to meter and precisely control the flow of fuel to the carburetor 2.

The carburetor 2 (FIG. 1) is conventional and includes the usual intake opening 10 and barrel or venturi at the base of the opening 10. The venturi has a throat into which a main jet projects, and this jet has an orifice at its end. The jet is connected with a float bowl 12 which is in turn connected to the fuel line 6 through a float valve. Thus, air passing through the venturi will experience a reduction in pressure at the throat, and this reduction in pressure causes gasoline from the jet to escape through the orifice into the throat as a mist which mixes with the air to form the combustible mixture. In the conventional arrangement, where the float bowl 12 is connected directly to the fuel pump 8, the proportion of gasoline in the mixture is too great for most operating conditions, and as a result the engine is not as efficient as it might otherwise be. Between the venturi and the intake manifold 4 is a throttle 14 which is operated by a throttle linkage 16 located externally of the carburetor 2. Normally, the linkage 16 extends all the way to the throttle or gas pedal 18 within the passenger compartment of the vehicle. The throttle 14 restricts the flow of the combustible mixture through the carburetor 2, and thereby controls the amount of combustible mixture delivered to manifold 4.

The control system A (FIG. 1) has two major components, namely a metering unit 20 and a sensing unit 22. Both are easily installed adjacent to the engine B. The metering unit 20 is in that portion of the fuel line 6 located between the fuel pump 8 and the float bowl 12. The sensing unit 22, on the other hand, is coupled to the throttle linkage 16 to sense the position of the throttle 14 for the carburetor 2.

Figure 2:
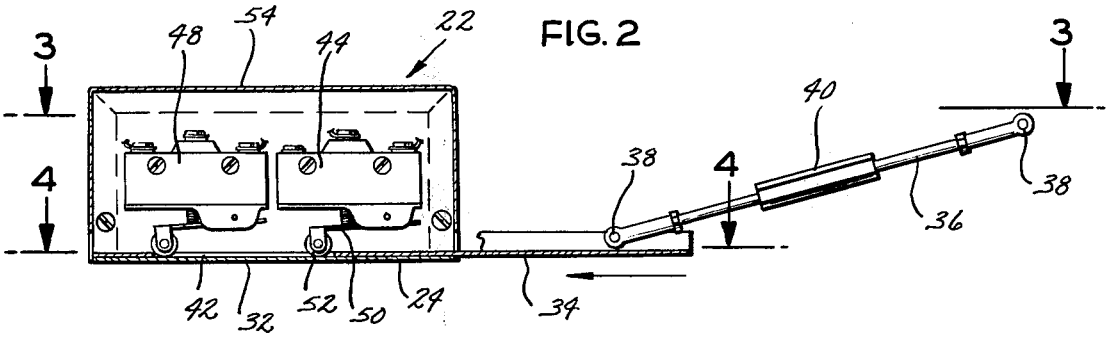
FIG. 2 is an elevational sectional view of the sensing unit for the control system, the view being taken along line 2—2 of FIG. 1.
Figure 3:
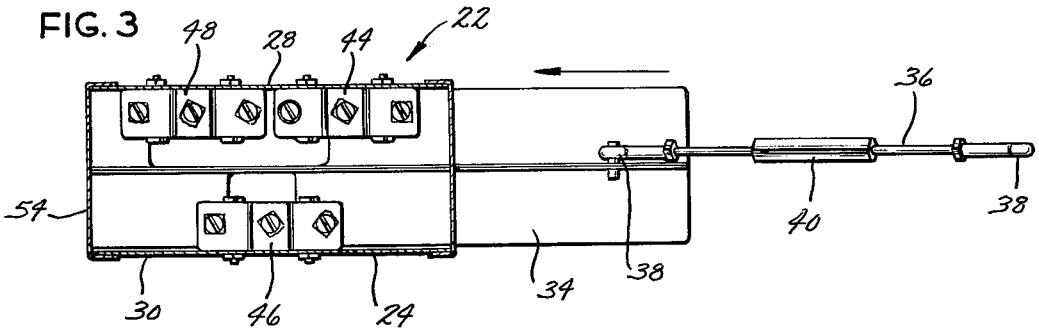
FIG. 3 is a sectional view of the sensing unit taken along line 3—3 of FIG. 2 and showing the switches.
Figure 4:
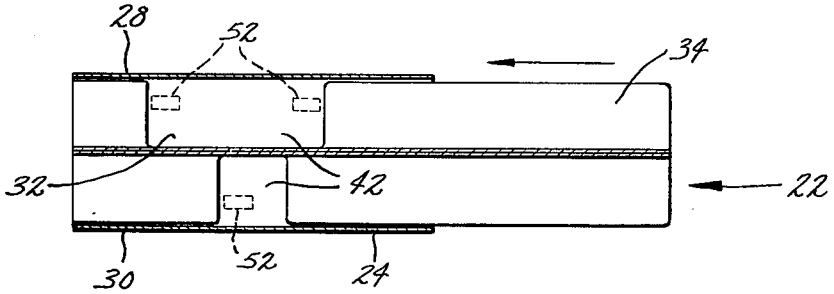
FIG. 4 is a sectional view of the sensing unit taken along line 4—4 of FIG. 2 and showing the slide.

Considering first the sensing unit 22 (FIGS. 2–4), it includes a U-shaped frame 24 which is mounted on the engine B by means of a suitable bracket 26, the specific configuration of which is dependent on the type of engine. While, the exact location of the sensing unit 22 is not critical, it is desirable to have it close to the throttle linkage 16. One location which has been found suitable, is directly above the intake manifold 4 and immediately behind the coupling between the throttle linkage 16 and the carburetor throttle 14 itself (FIG. 1). The frame 24, being U-shaped in configuration, has spaced apart side walls 28 and 30, and a base wall 32 connecting the two side walls 28 and 30. The base wall 30 supports a slide 34 which is free to move to and fro in the frame 24 parallel to the side walls 28 and 30. Indeed, the side walls 28 and 30 confine the slide 34 in the lateral direction, and thus serve to guide the slide 34 as it moves through the frame 24. One end of the slide 34 is connected to the throttle linkage 16 through a connecting link 36 having swivel joints 38 at its ends and an adjusting nut 40 intermediate to its ends. The nut 40 when turned varies the length of the link 36, thus enabling the position of the slide 34 to be varied relative to the throttle linkage 16. The slide 34 contains outputs 42 (FIG. 4) which are located along both of its side edges, with the cutout 42 along the frame side wall 28 being longer than the one along the frame side wall 30.

Mounted on the side walls 28 and 30 of the U-shaped frame 24 are first, second, and third microswitches 44, 46, and 48 (FIGS. 2 & 3) which are arranged in that order in the direction of slide movement. Actually, the first and third switches 44 and 48 are mounted on the wall 28, while only the second switch 46 is mounted on the wall 46. Each switch 44, 46 and 48 has a single actuating lever 50 (FIG. 2) provided with a roller follower 52 at its end, and the actuating levers 50 for the three switches 44, 46, and 48 are spring loaded such that their followers 52 are urged toward the base wall 32. Indeed, the followers 52 will contact the base wall 32 unless prevented by the slide 34. Each switch 44, 46 and 48 when actuated both breaks and makes a circuit and accordingly each has a normally open terminal, a normally closed terminal, and a common terminal. The slide 34 itself is thick enough to elevate the followers 52 sufficiently to actuate the switches 44, 46 and 48. However, the followers 52 are not always elevated by the slide 34, since the cutouts 42 in the slide 34 align with the followers 52. Indeed, when the engine B is at idle the slide 34 is positioned such that the followers 52 of all three switches 44, 46 and 48 are within the cutouts 42 and hence against the base wall 32. The slide 34 of course moves through the frame 24 as the carburetor throttle 14 is opened, and the cutouts 42 are arranged such that the follower 52 for the switch 44 first rides up onto the slide 34, then the follower for the switch 46, and finally the follower for the switch 48.

The U-shaped frame 24 of the sensing unit 22 is enclosed on its ends and top by a removable cover 54 through which wires from the three switches 44, 46, and 48 extend. The cover 54 also serves to confine and help guide the slide 34 in that it prevents the slide 34 from lifting off of the base wall 32.

The metering unit 20 likewise has a U-shaped frame 60 (FIG. 5) which is secured in the engine compartment of the automobile near the carburetor 2 for the engine B. The firewall will serve as a suitable mounting surface, and likewise so will either one of the fender wells. The frame 60 has a pair of parallel side walls 62 and a base wall 64 connecting the side walls 62. Projected from one of the side walls 62 are an inlet fitting 66 and an outlet fitting 68. The inlet fitting 66 is connected to a flexible fuel hose 70 which leads from the fuel pump 8, while outlet fitting 68 by means of another hose 72 is connected directly with the carburetor 2 at the usual inlet port which opens into the float bowl 12 thereof. Both of the hoses 70 and 72 are approved automotive gasoline hose and form part of the fuel line 6.

The inlet fitting 66 extends through the side wall 62 from which it projects and is coupled with an inlet manifold 76 which extends transversely through the interior of the frame 60. Likewise, the outlet port 68 connects with an outlet manifold 78 which extends through the interior of the frame 60 parallel to the manifold 76. Each manifold 76 and 78 has four ports 80, and corresponding ports 80 on the two manifolds are connected by tubing loops 82, 84, 86 and 88. Each tubing loop 82, 84, 86 and 88 is secured at its ends to its respective ports 80 in the manifolds 76 and 78 by suitable fittings. The tubing loops 82, 84, 86 and 88 may be considered branches into which the fuel line 6 is divided and may likewise be considered secondary fuel lines located between segments of the primary fuel line 6.

Figure 5:
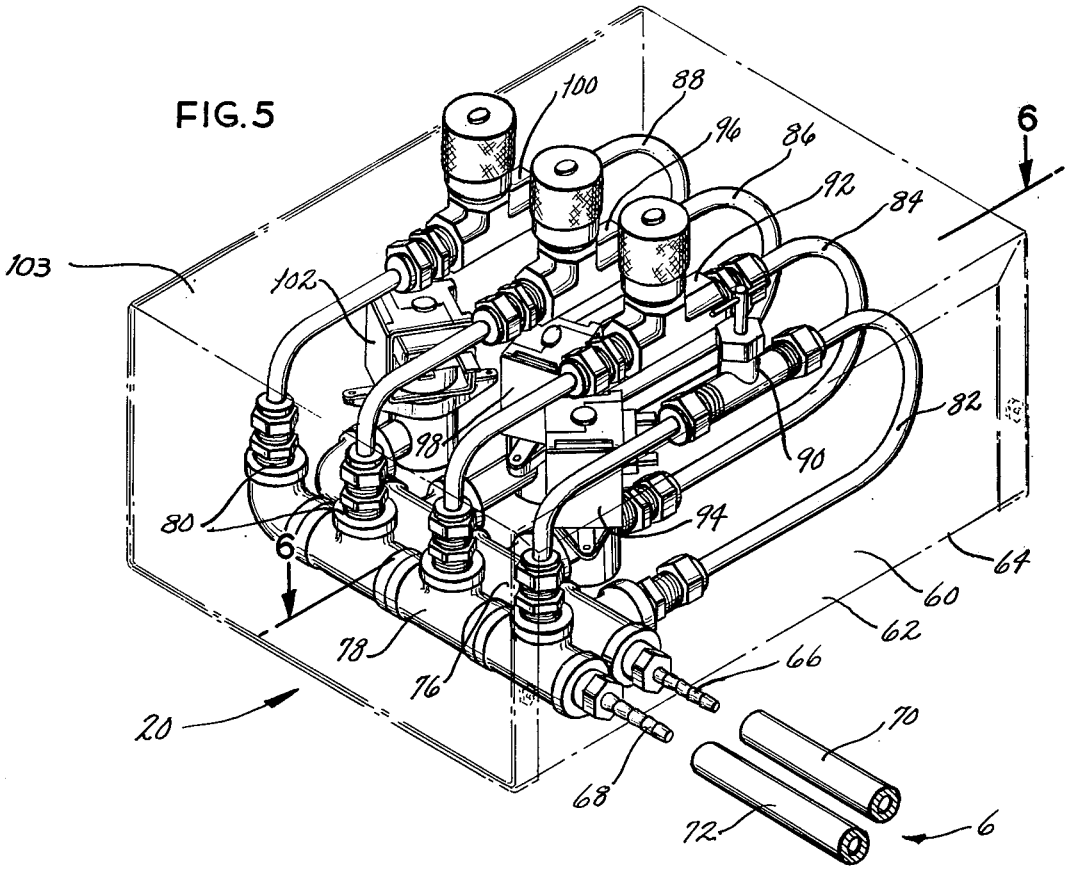
FIG. 5 is a perspective view of the metering unit for the control system with the housing thereof being illustrated in phantom lines to show the internal components.
Figure 8:
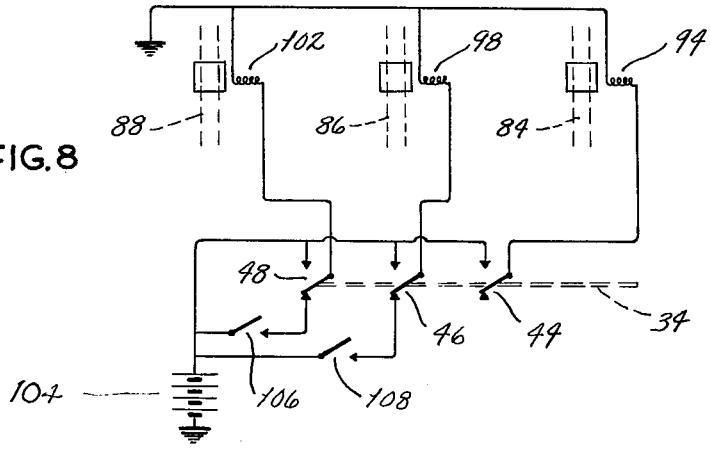
FIG. 8 is a schematic view of the electrical circuitry for the control system.
Figure 6:
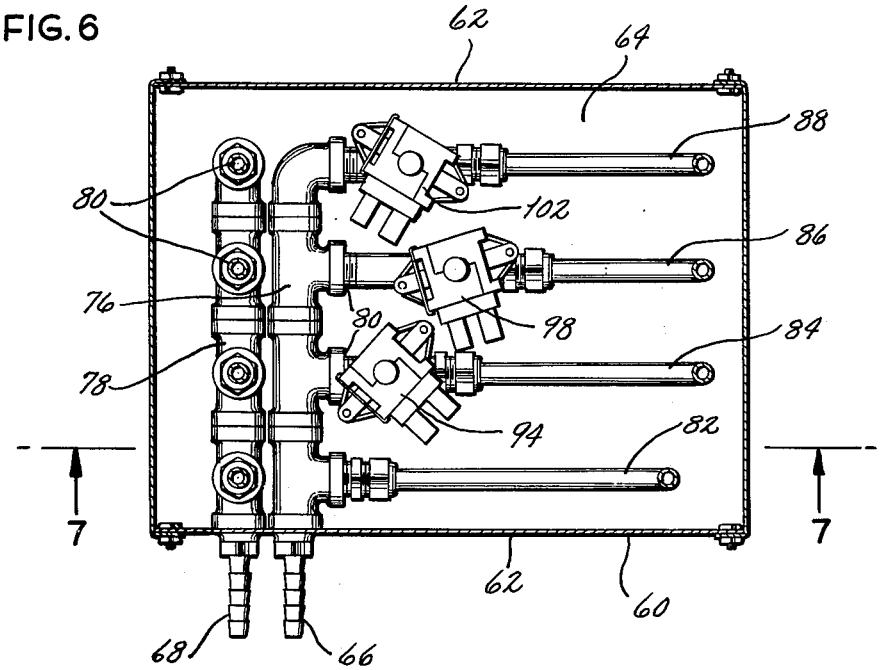
FIG. 6 is a sectional view of the metering unit taken along line 6—6 of FIG. 5 and showing the solenoid valves.
Figure 7:
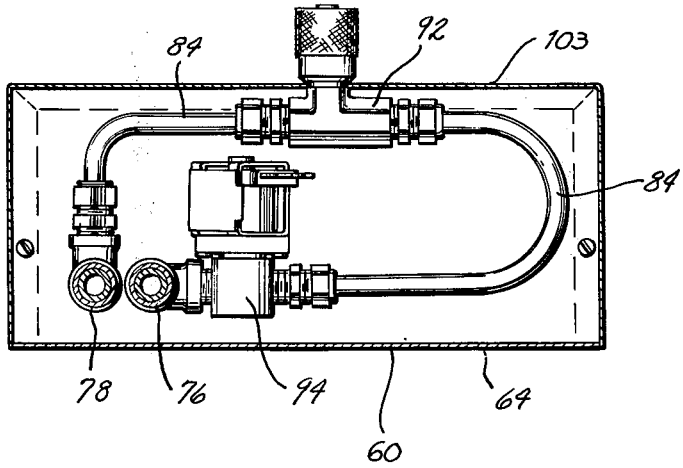
FIG. 7 is a sectional view of the metering unit taken along line 7—7 of FIG. 6.

The first tubing loop 82 contains an adjustable needle valve 90 (FIG. 1). The second loop 84 contains a micrometer flow control needle valve 92 and a solenoid valve 94 (FIG. 7). The micrometer valve 92 has a micrometer knob which when turned enables one to obtain precise control over the amount of fuel which passes through the valve 94. A Scovill-Schrader micrometer flow control needle valve is suitable for use as the micrometer valve 92. The solenoid valve 94 is normally closed and operates at the supply voltage for the ignition system on the engine B, that voltage normally being 12 volts DC. An ASCO solenoid valve, Cat. No. US 8261-7V, is suitable for this purpose. The third tubing looo 86 is similar to the second in that it contains a micrometer valve 96 and a solenoid valve 98 (FIG. 5). Likewise the fourth loop 88 contains a micrometer valve 100 and a solenoid valve 102. The micrometer valves 96 and 100 are the same as the micrometer valve 92, while the solenoid valves 98 and 102 are the same as the solenoid valve 94. Each solenoid valve 94, 98 and 102 possesses two terminals, with one terminal on each being connected by a common wire which in turn is connected to ground (FIG. 8). The other terminal on the valve 92 is connected with the common terminal of the microswitch 44 which is the first of the three switches to be operated by the slide 34 as the throttle 14 moves out of the idle position. Thus, the switch 44, the valve 94, which it operates, as well as the valve 92 control low speed operation. The other terminal on the valve 98 is connected with the common terminal of the switch 46 and controls medium speed operations. Finally, the other terminal or the valve 102 is connected with the common terminal on the switch 48 and controls high speed operation. The open portions of the frame 60 are enclosed by a cover 103 which bolts to the frame 60 and has apertures through which the control knobs for the valves 90, 92, 96 and 100 project. Thus, the valves 90, 92, 96 and 100 are easily adjusted.

The normally open terminals of the three microswitches 44, 46 and 48 are connected together by a common wire which in turn is connected to the electrical power source 104 (FIG. 8) for the engine B. The normally closed terminal for the second switch 46 is also connected to the power source 104, but not directly. Instead, it is connected through a thermostat 106 which is fitted into the block of the engine B to sense the temperature of the cooling fluid. The thermostat 106 is actually a switch which opens when the engine B reaches a predetermined operating temperature of about 100° F., but is otherwise closed. Thus, the high speed solenoid valve 102 remains open as long as the engine is below its normal operating temperature. The normally closed terminal of the medium speed switch 46, on the other hand, is connected to the starter switch 108 for the engine B such that when the starter is energized to crank the engine B, the medium speed solenoid valve 98 opens.

The control system A is designed primarily for use with automotive engines, but is also suitable for use on marine engines and industrial engines of the spark ignition variety. The system A is easily installed in the engine compartment of an automotive vehicle, and this installation requires nothing more than mounting the metering unit 20 at a suitable location, such as on the fire wall or fender well, and the sensing unit 22 adjacent to the throttle linkage 16. Also, the portion of the original fuel line 6 leading from the fuel pump 8 to the carburetor 2 must be detached and replaced by the hoses 70 and 72. In this regard, the hose 70 extends from the fuel pump to the inlet fitting 66 of the metering unit 20, whereas the hose 72 extends from the outlet fitting 68 of the metering unit 20 to the inlet port of the carburetor 2. Thus, all fuel which is supplied to the carburetor 2 must pass through the metering unit 20.

Normally, the metering unit 20 is preadjusted by the manufacturer such that the needle valve 90 supplies just enough fuel to keep the engine B operating at idle or up to a predetermined power setting, while the combination of the needle valve 90 and the low speed micrometer valve 92 supplies enough fuel to keep the vehicle operating on a level road up to about 50 mph. The combination of the needle valve 90 and the low and medium speed micrometer valves 92 and 96, on the other hand, supplies sufficient fuel to enable the engine to operate on a level road up to about 70 mph. When all micrometer valves 92, 96, and 100 are opened, sufficient fuel is supplied to enable the vehicle to operate at the maximum desired speed above about 70 mph. More precise adjustments can be made once the control system A is installed on the automobile, and these adjustments are obtained merely by turning the operating knobs for the micrometer valves 90, 96, and 100, as well as the operating element for the needle valve 90.

OPERATION

Under normal circumstances, the engine B is started while at ambient temperature. In this condition, the high speed solenoid valve 102 is open due to its connection to the power supply 104 through the thermostat 106 and normally closed terminal of the high speed switch 48 (FIG. 8). Also, when the starter switch 108 is closed to crank the engine B, the medium speed solenoid valve 98 will likewise open. The needle valve 90 is, of course, open all the time. Therefore, during the normal start, gasoline is supplied to the carburetor 2 through the first, third, and fourth tubing loops 82, 86 and 88. The solenoid valve 90 in the loop 82 and the micrometer valves 96 and 100 in the loops 86 and 88 enable sufficient fuel to pass to the carburetor 2 to provide the enriched mixture necessary to start the engine B. Once the engine fires and the starter switch 108 is released, the medium speed solenoid valve 98 closes so that fuel is now supplied only through the first and fourth tubing loops 82 and 88. These loops, despite the presence of the valves 90 and 102 in them, supply sufficient fuel to keep the engine B operating at idle, even though it requires an enriched mixture. Once the engine B warms up to the predetermined operating temperature of 100° F.±7° F., the thermostat 106 opens and breaks the circuit to the high speed solenoid valve 102, thus causing that valve to close and block the tubing loop 84. As a result, the fuel necessary to maintain the engine B at idle is supplied wholly through the first tubing loop 82. The needle valve 90 in this loop is adjusted so that no more fuel than is necessary to keep the engine operating at the desired low power setting is furnished.

By depressing the throttle pedal 18, the operator of the vehicle opens the carburetor throttle 14, and the engine B demands more fuel. As the throttle linkage 16 moves forwardly to open the carburetor throttle 14, it drives the slide 34 forwardly through its frame 24 and immediately above the idle position, the slide 34 lifts the actuating element of the first switch 44 so as to close the circuit through the normally open terminal of that switch. As a result, the low speed solenoid valve 94 in the second tubing loop 84 opens and the fuel necessary to operate the engine is supplied through both the first and second tubing loops 82 and 84. These two loops provide sufficient fuel to operate the engine up to a predetermined power setting, which may be that required to maintain the vehicle at a 50 mph speed on a level road. The air-fuel ratio is optimum near the upper end of this range and is slightly richer than necessary at the lower end, but even so the deviation from the optimum ratio at the low end of the range is not near as great as with a conventional fuel supply system.

At the point where the power setting for the first and second tubing loops 82 and 84 ends, the slide 34 lifts the actuating lever 50 for the medium speed microswitch 46 so that additional fuel is supplied through the third tubing loop 86, and this additional fuel is sufficient to operate the engine up to still another predetermined power setting, which constitutes the end of the third range and the beginning of the fourth range. Again the air-fuel ratio is optimum near the end of the third range and slightly rich at the beginning of it.

Finally, at the last power setting, the slide 34 actuates the third microswitch 48 so as to open the solenoid valve 102 and thereby bring the fourth tubing loop 88 into the fuel delivery circuit. Now all four loops supply fuel and the engine will operate up to a predetermined maximum power setting.

Whereas carburetors operated with conventional fuel supply systems furnish an excess of fuel, which results in an overly rich air-fuel mixture, the control system A, when properly adjusted, supplies a somewhat leaner air-fuel mixture and thereby conserves fuel. The air-fuel mixture approaches optimum conditions near the ends of the various ranges. Those ranges are, as previously mentioned, marked by the operation of the various switches 44, 46, and 48. The leaner air-fuel mixture results in less dilution of the crank case oil and reduces the emission of pollutants from engine B. The air-fuel mixture may be adjusted by turning the control knobs on the three micrometer valves 92, 96, and 100, so with the control system A it is possible to fine tune the engine B to the extent that it requires only slightly more fuel than is absolutely necessary. Moreover, the micrometer valves permit the engine B to be fine tuned for any particular altitude at which it will be operated.

Even greater fuel economy may be achieved by using more tubing loops with their associated micrometer valves and solenoid valves. In this way, the power range for each tubing loop would be reduced. In other words, the greater the number of tubing loops, the lesser the amount of excess fuel supplied at the low end of any power range. Of course, increasing the number of tubing loops requires an equivalent increase in the number of microswitches in the sensing unit 22.

The sensing unit 22 also controls the flow of gasoline when decelerating. Indeed, it shuts off all but the fuel required to sustain firing, for once the accelerator pedal 18 is released all fuel is stopped except the idle flow. When one normally decelerates from 55 mph to a full stop with a conventional fuel system, due to the engine vacuum, draw continues to cause the gasoline to flow into the engine at a rate sufficient to almost sustain 55 mph. The control system A allows only the fuel that can pass through the first loop 82 to flow into the engine, which is many times less than with a conventional fuel system.

This invention is intended to cover all changes and modifications of the example of the invention herein chosen for purposes of the disclosure which do not constitute departures from the spirit and scope of the invention.

What is claimed is:

1. In combination with an internal combustion engine of the spark ignition type and having a carburetor which is connected with a throttle and derives fuel of a fluent consistency from a primary fuel line that is connected with a source of such fuel, a control system to control the amount of fuel supplied to the carburetor, said control system comprising: a plurality of secondary fuel lines into which the primary fuel line is divided, one of the secondary fuel lines being continuously open while the engine is operating; electrically operated means in another of the secondary fuel lines for altering the amount of fuel delivered to the carburetor, the electrically operated means being responsive to electrical signals; and sensing means connected with and operated by the throttle for sending electrical signals to the electrically operated means such that the electrically operated means permits a greater amount of fuel to flow to the carburetor at higher throttle settings than at lower throttle settings.

2. In combination with an internal combustion engine of the spark ignition type and having a carburetor which is connected with a throttle and derives fuel of a fluent consistency from a fuel line that is connected with a source of such fuel, a control system to control the amount of fuel supplied to the carburetor, said control system comprising: means for dividing the fuel line into a plurality of branches, each of which is capable of directing fuel to the carburetor; electrically operated means for altering the amount of fuel delivered to the carburetor, the electrically operated means being responsive to electrical signals and including electrically operated shut-off valves in some of the branches, each valve having the capability of blocking the branch in which it is located when closed; and sensing means connected with and operated by the throttle for sending electrical signals to the electrically operated means such that the shut-off valves open progressively so that first one valve is open, then two, etc., as the throttle is moved from its low setting to its high setting, whereby the electrically operated means permits a greater amount of fuel to flow to the carburetor at higher throttle settings than at lower throttle settings.

3. The combination according to claim 2 and further comprising an adjustable valve in each branch that contains a shut-off valve, each adjustable valve forming a restriction in its branch so that the fuel supplied to the carburetor may be adjusted to be just enough to meet a desired power demand.

4. The combination according to claim 3 wherein one of the branches is continuously open while the engine is operating, said one branch having a restriction which permits merely enough fuel to pass through said one branch to maintain the engine operating substantially at a predetermined power setting.

5. The combination according to claim 4 wherein the restriction in said one branch is an adjustable valve.

6. The combination according to claim 2 wherein the sensing means includes a switch for each electrically operated shut-off valve and actuating means for closing the switches in succession as the throttle is moved to higher settings.

7. The combination according to claim 6 wherein the switches have actuating elements and the actuating means comprises a slide which is connected with the throttle and moves past the actuating elements of the switches as the throttle is opened, thereby actuating the switches.

8. The combination according to claim 2 and further comprising a thermostat positioned to sense the operating temperature of the engine and connected with one of the shut-off valves to maintain that valve open as long as the engine is below normal operating temperature, but to close the valve when the engine reaches a predetermined temperature.

9. The combination according to claim 2 wherein the engine has an electric starter which is energized through a starter switch; and wherein one of the shut-off valves is connected with the starter switch such that it is open when the starter is energized so that additional fuel will flow through the branch for said one shut-off valve when the engine is cranked by the starter.

10. In combination with an internal combustion engine of the spark ignition type and having a carburetor which derives fuel from a primary fuel line connected with a source of fuel, a control system to control the amount of fuel supplied to the carburetor; said control system comprising: sensing means for ascertaining power demands placed on the engine; and metering means interposed between the source of fuel and the carburetor for metering the fuel supplied to the carburetor in response to power demands sensed by the sensing means, the metering means including a plurality of secondary fuel lines which are interposed in the primary fuel line and shut-off valves in at least some of the secondary fuel lines for blocking those fuel lines, the valves being connected to and operated by the sensing means.

11. The combination according to claim 10 wherein at least some of the secondary fuel lines in addition to the shut-off valves have restrictions therein which permit a predetermined amount of fuel to flow at various power settings for the carburetor.

12. The combination according to claim 11 wherein the restrictions are adjustable to vary the amount of fuel which may pass through the secondary lines in which they are located.

13. The combination according to claim 10 in which one of the secondary lines is permanently open.

14. The combination according to claim 13 wherein the secondary line which is permanently open contains an adjustable valve which may be adjusted to basically provide enough fuel to maintain the engine operating at a predetermined power setting.

15. The structure according to claim 10 wherein the sensing means is connected to the throttle for the carburetor and senses the position of the throttle.

16. The structure according to claim 15 wherein the shut-off valves for blocking the secondary fuel lines are electrically operated and the sensing means includes a plurality of switches which, as the throttle is advanced, are actuated in succession such that more of the shut-off valves are open at higher power settings for the throttle than at lower power settings.

17. The combination according to claim 16 and further comprising a thermostat switch which is positioned to sense the engine operating temperature, the thermostat switch being connected to one of the shut-off valves such that the valve is open when the engine is below normal operating temperature and closed when the engine is at 100° F.±7° F. operating temperature.

18. The combination according to claim 16 wherein the engine is provided with an electric starter, and wherein one of the shut-off valves for blocking a secondary fuel line is connected with the electrical circuit for the starter such that said one valve is opened when the starter is energized.

* * * * *